United States Patent [19]

Sala et al.

[11] Patent Number: 4,826,357

[45] Date of Patent: May 2, 1989

[54] DEVICE FOR THE INTERNAL OCCLUSION OF TUBULAR FOUNDATION PILES

[75] Inventors: Oneglio Sala, Bologna; Roberto Fabbri, S. Sofia (Forli), both of Italy

[73] Assignee: Riva Calzoni S.P.A., Milan, Italy

[21] Appl. No.: 189,565

[22] Filed: May 3, 1988

[30] Foreign Application Priority Data

May 4, 1987 [IT] Italy ..... 20361 A/87

[51] Int. Cl.[4] ..... E02D 13/00

[52] U.S. Cl. ..... 405/232; 166/182; 138/89; 405/247; 405/195; 405/225

[58] Field of Search ..... 405/184, 232, 245, 246, 405/247, 173; 138/89; 166/123, 125, 181, 182; 285/39, 93

[56] References Cited

U.S. PATENT DOCUMENTS 3,343,607 9/1967 Current ..... 166/182
3,645,345 2/1972 Olsen et al. ..... 405/232 X
4,215,951 8/1980 Knox ..... 138/89 X
4,412,559 11/1983 Streich et al. ..... 138/89
4,421,138 12/1983 Nickles ..... 138/89
4,549,580 10/1985 Freeman ..... 138/89

*Primary Examiner*—Dennis L. Taylor
*Assistant Examiner*—Arlen L. Olsen
*Attorney, Agent, or Firm*—Herbert Dubno

[57] ABSTRACT

The device for the occlusion of the internal clearance of tubular foundation piles according to the invention comprises a plug, consisting of a shutter and a deforming ring cooperating with a deformation fixture capable to impart to the plug the opening position for its blockage within the pile, wherein the shutter consists of a cylindrical body which can be restrained by the deformation fixture, having close to its upper margin a plurality of axially oriented lamellar elements, which can be laterally deflected as a result of the insertion of the deforming ring into the cylindrical body under the action of the deforming fixture, going from a configuration with a smaller external diameter than the one of the rings previously fastened in the pile for this purpose, to a configuration with a larger diameter than the one of the same rings.

16 Claims, 6 Drawing Sheets

DEVICE FOR THE INTERNAL OCCLUSION OF TUBULAR FOUNDATION PILES

FIELD OF THE INVENTION

Our present invention relates to a device for the occlusion of the internal cross section of a tubular foundation pile and which may provide an opening for water flow in a ramming or driving stage.

More particularly, the invention relates to a device which can be used to at least partially plug the interior of the foundation pile at any desired height and can be locked in place against movement therein with a minimum of effort.

BACKGROUND OF THE INVENTION

In civil engineering generally and in land, maritime and offshore constructions, there is widespread use of foundation piles. The piles support the load of a structure to be built in terrains where the ground or subsurface are not sufficiently resistant to loading and may tend to displace under the weight of the structure and with time.

Foundation piles of the type with which the invention is concerned can be made of various materials, but generally are composed of metal and are of a strength sufficient to enable the pile to be driven into the soil by the pile driver.

During the pile-driving operation, the pile being driven into the soil separates the soil outside of the pile from soil contained within the pile and often referred to as the core.

The load carrying capacity of the pile is usually determined by the sum of the friction of its external and internal surfaces with the soil.

In some cases and under some ground conditions, the load capacity provided solely by such friction has been found to be insufficient. It can be increased either by increasing the length of the pile driven into the soil with a higher consumption of piling and more labor for pile driving, thereby increasing the cost of the foundation. It can also be increased by inserting plugs within the piles to prevent the sliding of the soil past the plug. In such cases, the load support capacity is determined in part by the force with which the plugs can react against the soil therebelow.

Various approaches to the plugging of a tubular pile have been used in practice. For example, plugs made of concrete can be used, the concrete being cast in place within the pile after the pile has been driven into the soil. This system has the disadvantage that one must wait for the cast plug to set. Moreover, because the cast plug is somewhat brittle and has only limited compressive strength, it is not possible, in practice, to drive the pile further after the plug has been provided.

It has also been proposed to weld diaphragms within the pile in order to obstruct the cross section thereof. This approach, however, requires determination of the location of the diaphragm with great precision and possibly limit the length of the pile and the manner in which the pile is driven into the soil.

There have also been provided plugs which can be lowered into the pile shortly before a driving operation is completed and which are permanently deformed at the desired location by an internal pressure with the pile being then subjected to addition driving to block the internal core against that plug. While these plugs tend to be highly effective for the purposes described, the plug structures used in the past have required very high forces and pressures to set them into position, thereby making use of such plugs expensive and complex.

OBJECTS OF THE INVENTION

It is therefore, the principal object of our present invention to provide a device for the occlusion of the interior of a tubular pile which will have the advantages of the plug-type obturation devices previously described but will be free from their drawbacks.

Another object of the invention is to provide a device for the occlusion of a tubular foundation pile which enables the interior of the pile to be obstructed by the device in any required position and which enables the device to be blocked within the pile in a particularly simple manner and without a large expenditure of energy.

SUMMARY OF THE INVENTION

These objects and others which will become apparent hereinafter are attained, in accordance with the present invention, in an occlusion device for the interior of a tubular foundation pile which comprises a plug consisting of a shutter and a deforming ring coaxial therewith.

The deforming ring is associated with a deformation fixture adapted to in part to the plug an opening configuration required for blocking the shutter in place within the pile. The shutter comprises a cylindrical body which can be restrained between deformation fixture and has along its upper margin or rim an array of laterally outwardly deformable axially extending lamellar elements which can be urged outwardly by insertion of the deformation ring into the cylindrical body under the action of the deformation fixture. The deformation fixture has frustoconical surface for camming the elements outwardly and has a smaller diameter portion less than the diameter of the lamellar elements and a larger diameter greater than the diameter of the lamellar elements to insure such camming action.

Within the interior of the pile at least one ring is previously provided to constitute an abutment and the lamellar elements are deformed by the deformation ring to a diameter greater than the inner diameter of such ring so that the elements can lodge beneath and be braced against this ring.

More particularly, the device can comprise:

a shutter member insertable in a tubular foundation pile to a selected depth, the shutter member being adapted to close off at least part of the cross section of the pile and being formed with an annular array of lamellar elements along an upper margin of the shutter member deformable laterally outwardly in a direction of an internal wall of the pile;

a deformation ring member coaxial with the shutter member and receivable within the array and having a generally frustoconical outer surface having a small diameter less than the inner diameter of the lamellar elements at an upper end of the array and a large diameter greater than the inner diameter of the lamellar elements at the upper end of the array whereby the telescoping of the deforming ring member into the shutter member drives the lamellar elements outwardly, the members together forming a plug; and a fixture releasably connected to the shutter member and restraining same, the fixture being provided with driver means for forcing the deformation ring member into the shutter member to force the lamellar elements outwardly and lock the plug in the tubular pile, and means for releasing the fixture from the pile after the plug has been locked in the pile.

Especially advantageous is an arrangement in which the plug consists of a substantially obstructive cylindrical body provided with suspension and centering elements cooperating with the deformation fixture and having, extending downwardly from the upper edge of the cylinder, multiplicity of axial slots which define the lamellar elements between them so that these elements effectively form petals which can be deflected outwardly. The lamellar elements can have conical surfaces at their upper ends, widening outwardly to cooperate with the frustoconical surface of the deformation ring member. Below the frustoconical surface of the elements, the elements can define an internal annular groove adjacent the conical surface to constitute inwardly indirected teeth on each of the petals or elements.

The deforming ring member can consist of a generally cylindrical ring which can be axially slidable within the shutter member so that the shutter member and the ring can telescope together.

The ring is provided with an external frustoconical surface as described, widening upwardly and with a larger diameter greater than the smaller diameter of the internal frustoconical surface of the array of elements of the shutter member.

The upper edge of the cylindrical ring forming the deforming ring member is dimensioned so that it can engage beneath the teeth of the elements when the elements are fully deformed outwardly, thereby locking the deformation ring member against movement out of engagement with the shutter member.

The deformation fixture comprises an external support body provided with suspension means by which the unit consisting of the fixture and the plug can be lowered into the pile and by means of which the deformation fixture can be extracted from the pile upon setting of the plug behind one of the abutment rings welded to the inner wall of the pile.

Usually a number of such rings are provided at different levels to allow the level at which the plug is set to be selected from the surface of the ground or externally of the pile.

The deformation fixture has at least one actuator capable of exerting an axial action and fastening elements for releasably attaching the shutter member to the fixture. The actuator or other loading means is defined to apply opposite axial thrusts to the deformation ring member and the shutter member causing the insertion of the deformation ring member into the shutter member, lateral deformation of the lamellar elements outwardly and the engagement of the lamellar elements beneath the abutment ring.

Advantageously, the deformation fixture comprises a support frame on which controllable jaws were provided for restraining the suspension member of the shutter on the frame. This suspension member can be an upwardly extending shaft or stem and the jaws maybe laterally closable about the stem. One or more actuators braced between the frame and the deforming ring can drive the deforming ring into the shutter member.

Alternatively, the deformation fixture comprises an extend support body with a centrally disposed actuator whose shaft or rod is connectable by disengaging fastening means to the shutter member. The support body is braced against the deformation ring so that upon retraction of the piston rod, the deformation ring is driven into the shutter member to laterally displace the petal elements outwardly.

The detachable fastening means can include a bolt with a preselected breaking tension or stress, i.e. a predetermined rupture point, capable of resisting the axial stress applied to the bolt in the lateral deformation of the lamellar elements, but rupturing upon an increase in this stress as results from continued operation of the actuating means beyond the second of the lamellar behind the abutment ring.

We have found it to be advantageous, moreover, to provide position sensor's on the assembly of the pile and the deformation fixture for detection of the abutment rings as the assembly is lowered into the pile or to provide other position detector means capable of indicating the point to which the plug has been lowered. Sensor means may also be provided to signal the action of the actuators so that full extension or retraction of the actuator or actuators, indicating setting of the plug, can be signaled to a control location.

The actuators can be hydraulic jacks supplied from a remote source, for example a grade level pump, although the deformation fixture can also have energy storage elements and remote control elements which can trigger the actuators. Thus a central hydraulic stage may supply the jacks or a central control stage maybe provided to operate the remote control unit on the assembly and trigger the actuators. Respective cables may interconnect the remote control location with the example and, of course, hydraulic conduits may form the connection if a central hydraulic pump step is provided.

The plug should be provided with an opterature or other closure system capable of allowing water flow past the plug between blocking the passage of the core of soil. This passage may be blocked by simply leaving openings with a total free area between 20% and 30% of the free internal cross section of the pile.

BRIEF DESCRIPTION OF THE DRAWINGS

The above and other objects, features and advantages of our invention will become more readily apparent from the following description, reference being made to the accompanying highly diagrammatic drawing in which.

SPECIFIC DESCRIPTION

Figure 1:
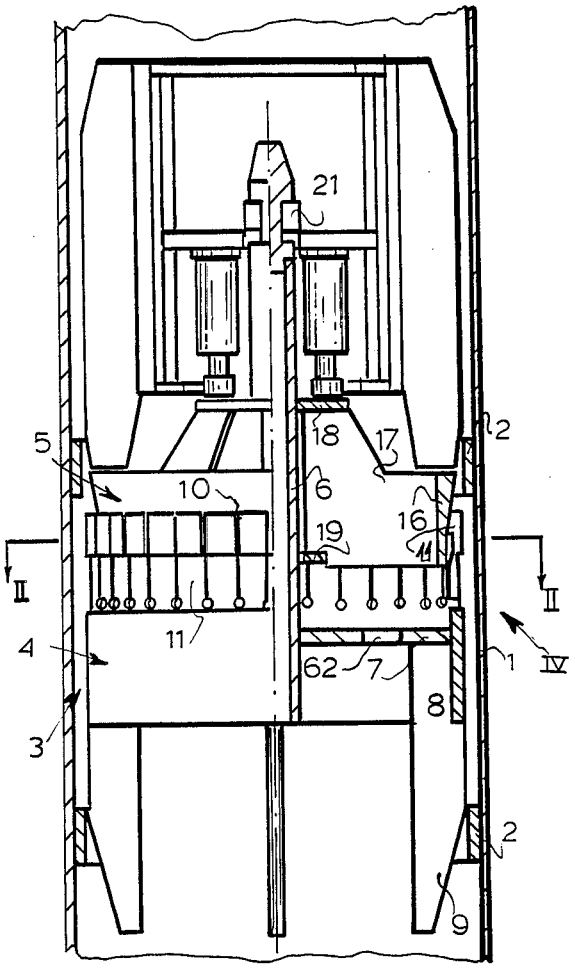
FIG. 1 is an axial cross sectional view through a tubular foundation pile illustrating the assembly of the inventions prior to setting of the shutter member and illustrating two abutment rings welded to the inner wall of the pile, in the right hand portion, the shutter member and deformation ring being illustrated in section while in the left hand portion the plug is shown in elevation.
Figure 2:
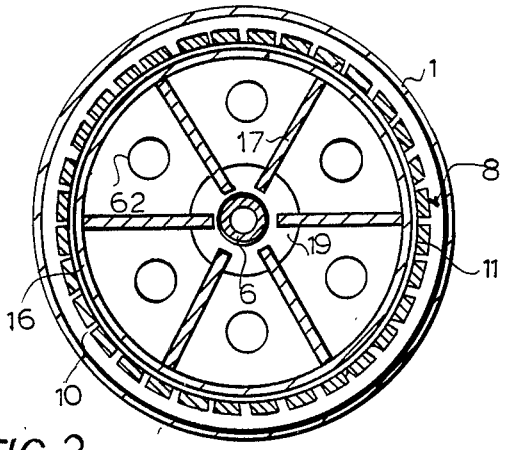
FIG. 2 is a cross section view taken generally along the line II—II of FIG. 1.
Figure 3:
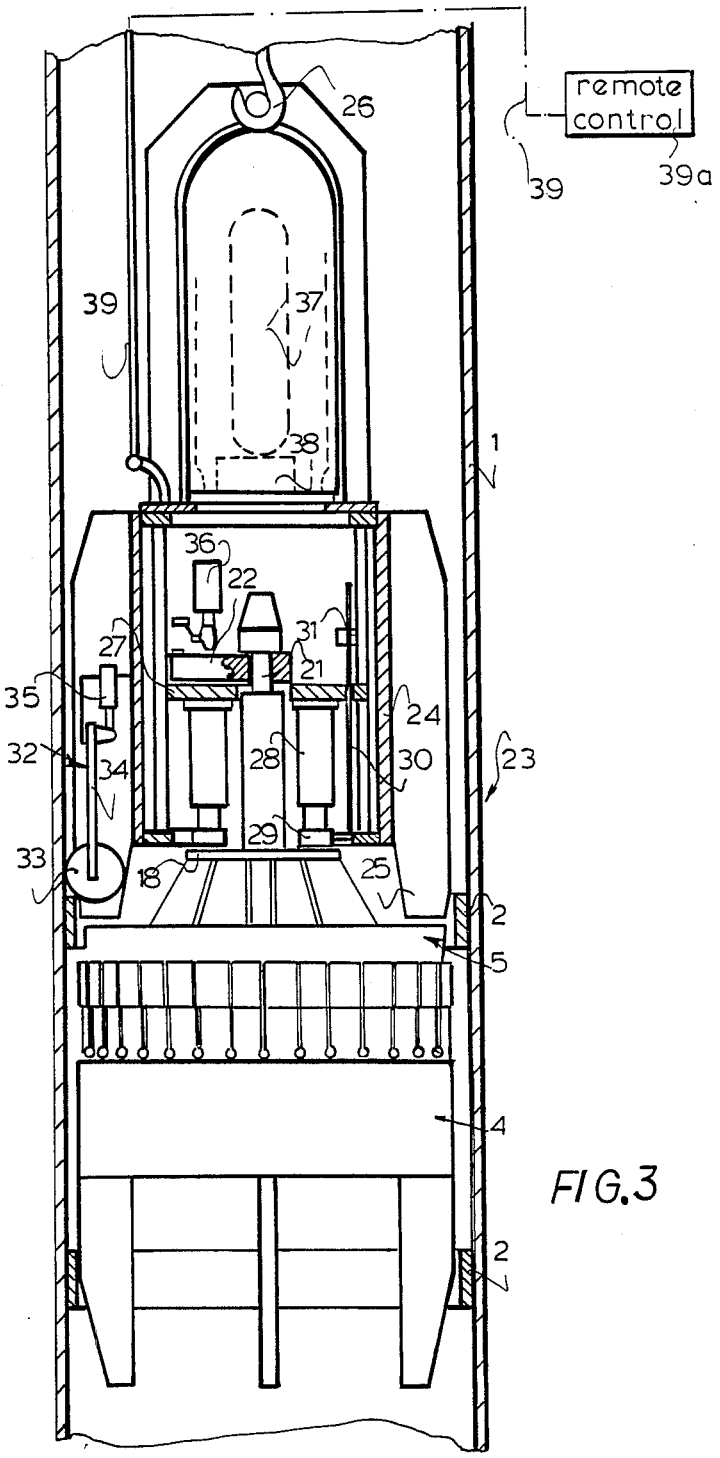
FIG. 3 is a view similar to FIG. 2 but with the deformation fixture shown partly in section and in greater detail and with the sensing elements illustrated.

As shown in FIGS. 1, 2 and 3, a foundation pile 1 consisting of a tubular steel element driven into the soil to a desired depth, and in which several blockage rings 2 are affixed by welding or the like during its manufacture.

A plug 3 is lowered into the tubular plate 1, the plug being shown partially in section in FIG. 1 and consisting basically of a shutter member 4 and a deformation ring member 5, axially movable with respect to the shutter member 4, the deformation ring member 5, sliding on the tubular shaft 6 which is part of the shutter member.

As can be seen from FIG. 1, the shutter member consists of a plate 7 to which the shaft 6 is affixed, surrounded by a cylindrical body 8, provided with three or more radial centering guides 9 within the clearance of the pile 1.

Figure 4:
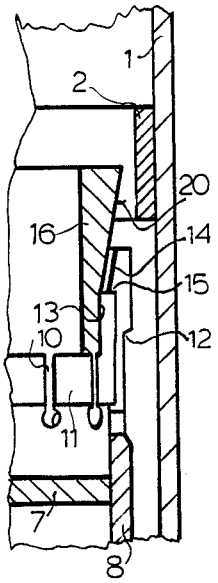
FIG. 4 is a detailed view of the region IV of FIG. 1 drawn to a larger scale.

The cylindrical body has an upper portion provided with a plurality of axial incisions 10 which define several axially extending lamellar 11 or "petals", whose surfaces as best shown in FIG. 4, have an annular groove 13, which in cooperation with the frustoconical hollow 14 of the upper extremity of the internal surface of the body 8 defines the restraining teeth 15 of the "petals" 11.

The deformation ring member 5 consists of an essentially cylindrical body 16, supported by several spokes 17 all aground the rings 18 and 19, slidable along the shaft 6. The body 16 has an external conical surface 20, with an inclination corresponding to that of the frustoconical hollow 14 located inside the body 8 and with its larger diameter greater than the smaller diameter of the hollow 14.

At the top of the shaft 6, there is an annular groove 21, capable of engagement by the jaws 22 of an actuating device 23, shown.

The actuating device consists basically of a cylindrical frame 24, provided with radial centering guides 25 within the pile and suspended by means of a hook 26 together with the plug unit to an external winch, not shown in the drawing, through which the entire unit can be lowered inside the pile to the desired depth.

The frame 24 comprises a plate 27, on which the jaws 22, which can be opened are mounted, as well as one or more jacks 28, advantageously of the oleodynamic type, capable to act with the corresponding frontal extremity 29 aganist the upper ring 18 of the deformation ring member 5.

Associated to the extremity 29 of one of the oleodynamic jacks, there is a rod 30, connected to the position-sensing element 31, monitoring for the complete extension of the jacks. The element 31 may be a limit switch or a proximity switch.

Also, on the frame 24 one or more sensors 32 are treated for detecting the position of the rings within the pile, each of these consisting of a wheel 33 positioned at the extremity of a rod 34 provided at the back with an elastic return element 35, which detects the presence and the position of the ring and makes it possible to trigger the actuation of the actuating device in a precise position of the plug with respect to a preselected ring.

The gripping jaws 22 are triggered to open by a release cylinder 36 after the plug has been stopped. The energy required for operating the hydraulic equipment of this fixture can be furnished by an independent oleodynamic central pumping station mounted on the fixture, or, as shown in broken lines, by one or several accumulators under pressure 37 forming means for supplying energy to the driver means and by the pertinent electric and hydraulic control and drive units 38. The trigger signals for the actuation of the jacks 28 and release cylinder 36 are sent from the outside, through a connecting cable or conduit 39. The block 39*a* connected to the cables or conduits represented at 39 can be the remote control means for the apparatus, consisting of a pressure source and the control switches, circuitry and valves required for the control operation.

When the assembly consisting of the fixture and the plug are lowered to the desired depth within the tubular pile 1 driven into the ground, the lowering motion is stopped corresponding to the level of a ring 2, detected by the sensor 32, with possible position corrections with fine maneuvers of the winch.

Then through the connecting cable 39, the opening of the plug is triggered, in order to block it inside the pile.

The jacks 28, acting with the respective extremities 29 against the ring 18, push the deformation ring member 15 into the body 8 of the shutter member, which, in this way, is restrained by the rod 6 between the jaws 22.

Figure 5:
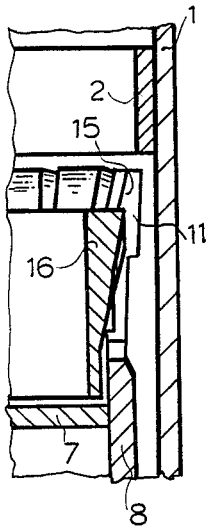
FIG. 5 is a view similar to FIG. 4 showing the lamellar elements in their outwardly deflected positions and engaging the deformation ring against retraction.
Figure 6:
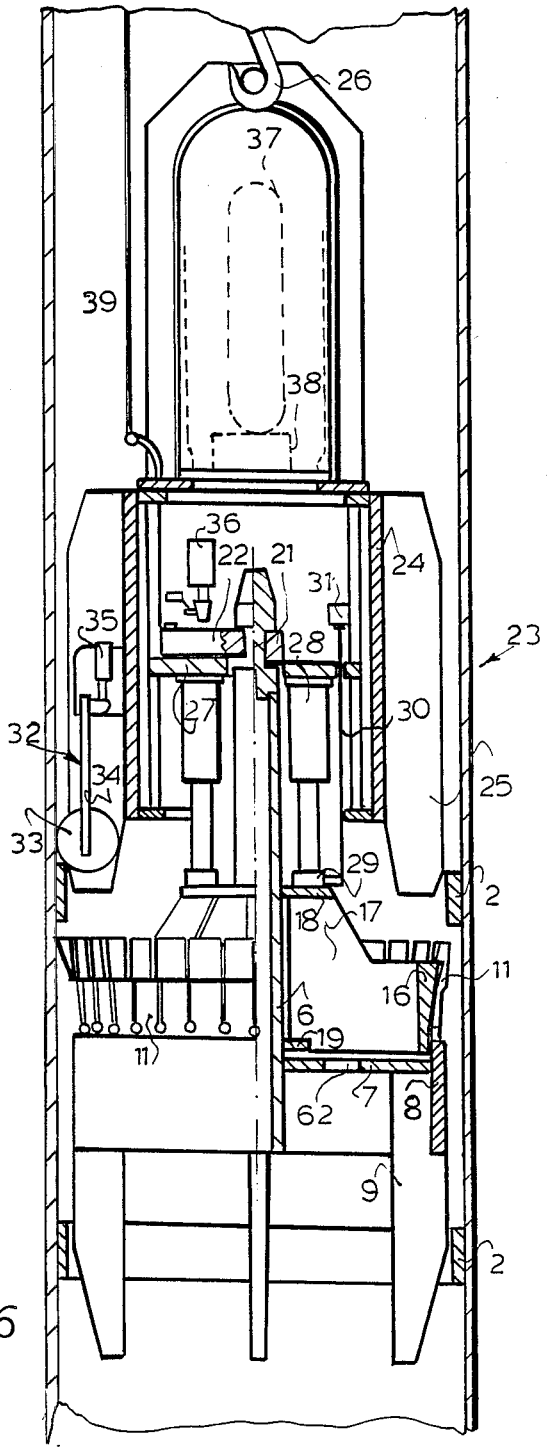
FIG. 6 is a view similar to FIG. 3 showing the plug in its open position.

The deformation fixture produces then an outward deflection of the "petals" 11, as shown in FIGS. 5, 6, permanently deforming them, in order to bring the upper external edges of the petals of the shutter member body 8 to a larger diameter than the internal diameter of the rings 2.

The final position of the deformation fixture corresponds to a height (level) which is such that the elastic resiliency of the deformation imparted to the petals 11 brings their inner tooth 15 to lodge on top of the deformation fixture, locking it into position and preventing its extraction.

This maintains the petals 11 in deflected position, with an extreme external diameter a little smaller than the internal diameter of the pile and larger than the internal diameter of the superpositioned ring, thus maintaining the plug in its entirety locked in the position assumed within the pile.

When the sensor element 31 has established that the shafts of the jacks 28 have reached their complete extension, corresponding to the final locking position to be assumed by the deformation fixture within the shutter member of the plug, the release of the jaws 22 from the shaft 6 is triggered and the plug anchored in this way is abandoned or lost in the pile, while the fixture is retrieved. An additional driving of the pile, if required, insures the final blockage (plugging) of the core inside the pile.

Figure 7:
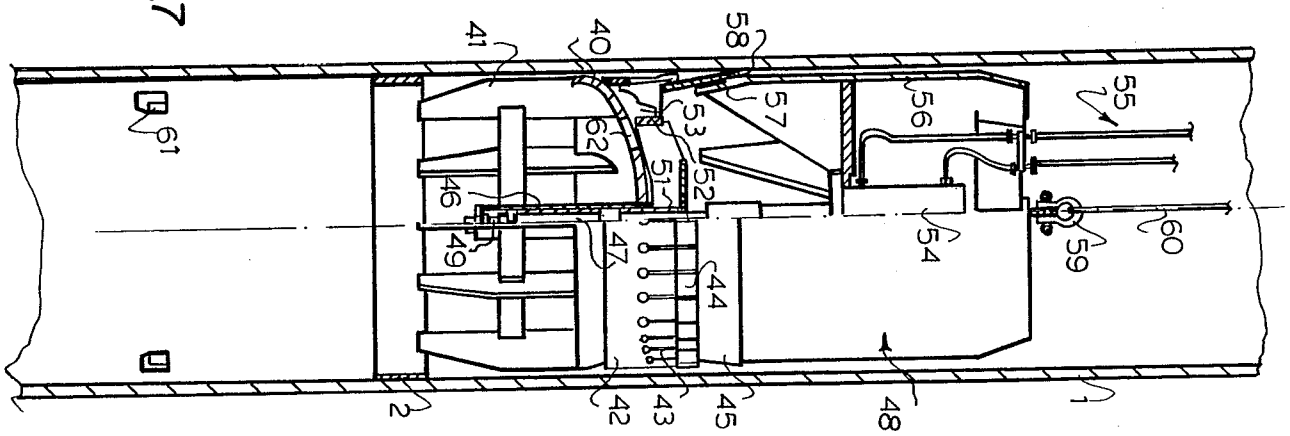
FIG. 7 is an axial cross section through a tubular pile showing an example according to another embodiment of the invention with the right hand side in elevation and the left hand side in axial section.

In FIG. 7, an alternative embodiment of the invention is shown, wherein the shutter member consists of a cap 40, carrying several radial centering guides 41, to which a ring 42 is fastened having cuts 43 defining lamellae 44. The shape of the lamellae 44 is identical to the one already described in FIGS. 4 and 5.

Inside the ring 42, there is a conical deformation ring member 45. The cap 40 also carries an axial tubular element 46, which is an integral part thereof, wherein the shaft 47 of a deformation element 48 inserts, this element being fastened to the lower extremity of the tubular element 46 via a bolt 49 with a preselected breaking or rupture point.

The shaft 47 is slidably inserted into the guiding element 50, having a portion which is insertable between the tubular element 46 and a ring 52 concentric therewith, capable of being inserted through the wings 53, which are part of the cap 40, insuring the centering between the deformation member 48 and the shutter member.

The deformation member 48 basically consists of an actuator 54, of the hydraulic type, carrying the shaft 47 and supplied by the ducts 55, connected to central oleodynamic station located at the surface, supported in a cylindrical body 56 with lower conical portions 57, insertable into the deformation ring member 45, resting on its supper edge with projection 58.

A shackle 59, connected to a suspension cable or chain 60 makes possible the lowering of the assembly into the pile 1. The cylindrical body 56 of the deformation member 56 has the function to support, protect, guide and to ballast the actuator 54 during its up- and down travel in the pile.

When the desired position is reached in the tube 1 under a ring 2, controlled either the length of suspension cable 60 or through the sensing elements located on the edge of the deformation member, which are not shown in the drawing and can be of a type known per se, the actuator 54 is triggered, causing with its traction on the shaft 47 and the thrust via the projection 58 upon the deformation ring member 42 the insertion of the same into the ring 42, spreading the lamellae 44 and locking the ring inside them, as shown in FIG. 5. For this purpose, the thickness of the deformation ring member 45 has to be greater than the depth of the projection 58.

Figure 8:
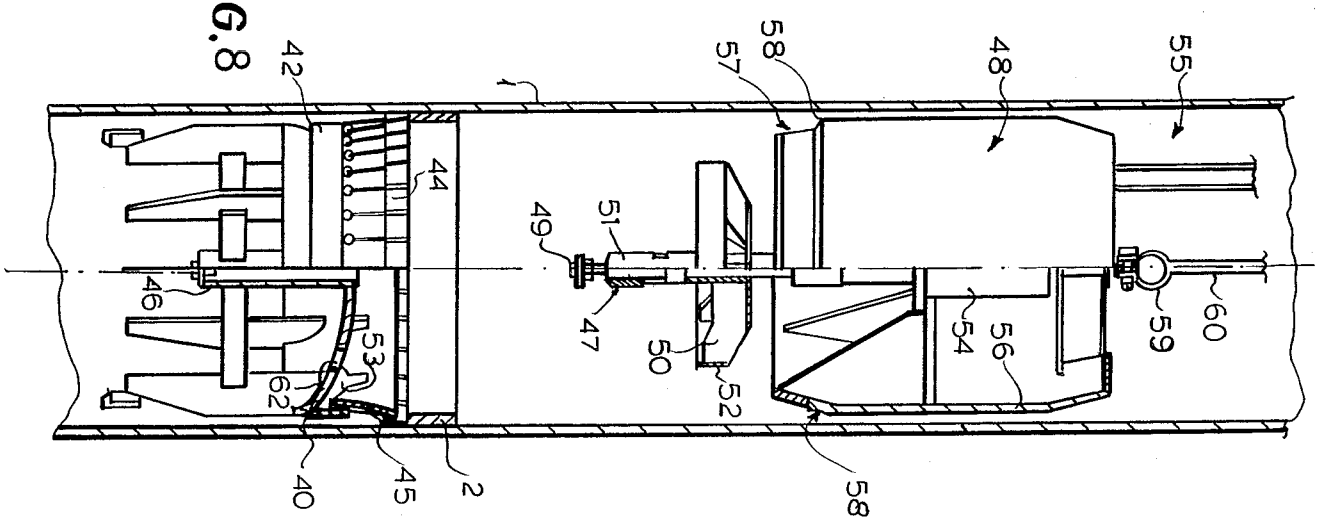
FIG. 8 is a view of the example after separation of the plug from the deformation fixture and following setting of the plug.

Once the deformation of the lamellae 44 has been completed, and they are now distended to an external diameter larger than the internal diameter of the ring 2, the traction of the actuator 54 is increased, in order to reach the breaking point of the bolt 49, as shown in FIG. 8, freeing this way the deformation fixture, which can then be separated and extracted from the pile, for reuse.

The bolt with preselected breaking point 49 is so dimensioned as to resist to the weight of the plug and the deformation load of the lamellae 44 of the ring 42, fracturing at a higher load, which can be imparted by the actuator 54.

The breaking of the bolt 49 is signalled to the surface by the fact that the pressure supplied to the actuator has reached the level required for the breaking load and by the subsequent falling of the pressure in the system.

In order to avoid surpassing a predetermined maximum depth during the lowering of the plug in the tubular pile 1, we provide limiting stops 61, having an internal diameter smaller than the maximum diameter of the shutter member are provided, preventing the shutter member from moving further than the preselected value.

During the ramming operation of the pile, which follows the locking of the plug in its location, having the purpose of achieving a blocking of the soil core in the pile, for instance up to a value equivalent to a pressure of approximately 70 bar, the presence of a column of water and mud proves to be particularly damaging.

In fact, in the cases when the plug is sealed or has very small openings for the passage of water, at the typical frequency of the ramming operation dynamic effects are produced, causing the column of water and mud to create a kind of elastic cushion in the pile under the plug which cancels or generally reduces the ramming effect and prevents the desired locking level of the core to be achieved.

In order to avoid such inconveniences, it is necessary to provide the plug with openings, large enough to insure an adequate passage of the water, during the ramming of the pile. For this purpose, in the cap 40 of the embodiment in FIGS. 7, 8 or in the plate 7 of the embodiment shown in FIGS. 1 to 6, holes 62 are provided, in a number and with a diameter adjusted to the required water flow.

Figure 9:
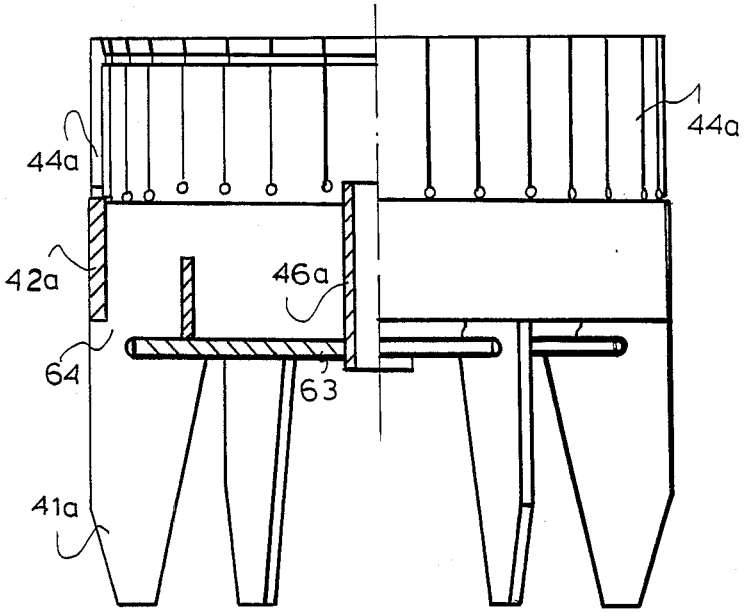
FIG. 9 is an elevation view, partly broken away, of the shutter member of a plug in accordance with the invention, this view corresponding to a view taken along the line IX—IX of FIG. 10.
Figure 10:
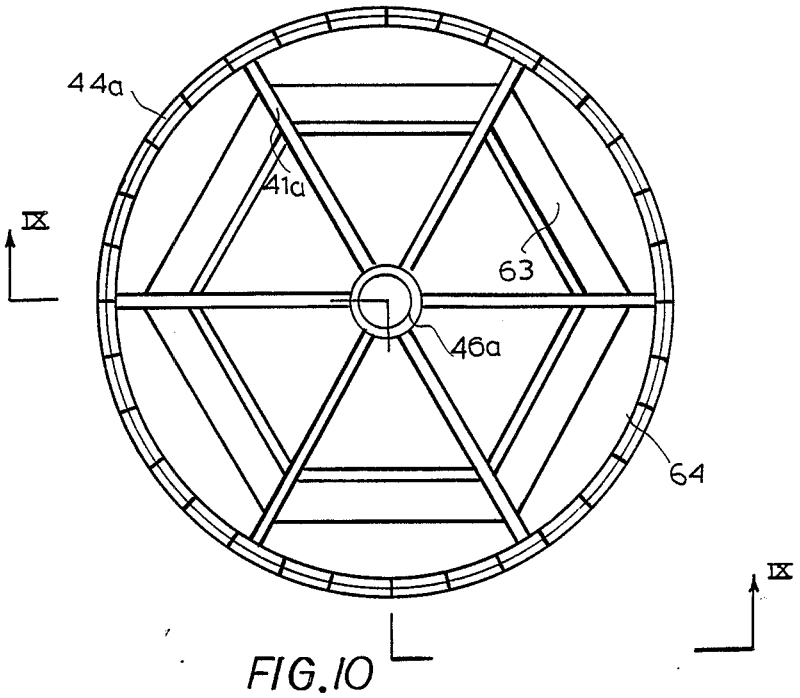
FIG. 10 is a top plan view of the latter shutter member.

As a further alternative, the plug can also be made as shown in FIGS. 9, 10 where, instead of the cap 40 of FIGS. 7, 8 it has a plate 63, fastened to the radial guides **41*a* and to the tubular element 46*a*; such a plate has a polygonal shape or generally extends in a radial direction by a value smaller than the internal diameter of the ring 42*a*, provided with lamellae 44*a***.

In such an embodiment, between the plate 62 and the internal surface of the ring **42*a*, a free space 64** is reserved, which is sufficient to allow the required passage of the water flow.

Advantageously, the area of this passage, achieved either as shown in FIGS. 9, 10 or through holes 62, as in FIGS. 1 to 8, has to be equal to about 25% of the internal area of the pile, in order to avoid the elastic effects mentioned above, and generally range between 20 and 30% of the internal area of the pile.

We claim:

1. A device for the internal obturation of a tubular foundation pile, comprising:

a shutter member insertable in a tubular foundation pile to a selected depth, said shutter member being adapted to close off at least part of the cross section of said pile and being formed with an annular array of lamellar elements along an upper margin of the shutter member deformable laterally outwardly in a direction of an internal wall of said pile;

a deformation ring member coaxial with said shutter member and receivable within said array and having a generally frustoconical outer surface having a small diameter less than the inner diameter of said lamellar elements at an upper end of said array and a large diameter greater than said inner diameter of said lamellar elements at said upper end of said array whereby the telescoping of said deforming ring member into said shutter member drives said lamellar elements outwardly, said members together forming a plug; and a fixture releasably connected to said shutter member and restraining same, said fixture being provided with driver means for forcing said deformation ring member into said shutter member to force said lamellar elements outwardly and lock said plug in said tubular pile, and means for releasing said fixture from said pile after said plug has been locked in said pile.

2. The device defined in claim 1 wherein said plug shutter member comprises:

a cylindrical body provided with means extending across at least part of the internal cross section of said pile for obstructing the interior thereof, which suspension and centering device on said body, and means forming a plurality of axial incisions in said body along an upper edge thereof defining between them said lamellar elements, said array of lamellar elements being formed adjacent said upper edge with an internal frustoconical surface cooperating with the frustoconical outer surface of said ring member, and an annular internal groove adjacent the frustoconical surface of said array and defining on each of said lamellar elements a respective retaining tooth engageable over said deformation ring member.

3. The device defined in claim 2 wherein said frustoconical outer surface extends partly into said shutter member and said array as said plug is lowered into said pile.

4. The device defined in claim 2 wherein said suspension and centering device suspend said shutter member from and centers said shutter member with respect to said fixture, said fixture comprising a support frame provided with means for suspending said assembly from an external apparatus adapted to lower said assembly into said pile, and means for axially and releasably coupling said frame to said suspension and centering device, said driver means including at least one fluid-responsive element braced between said frame and one of said members for forcing said ring member into said shutter member to deflect said lamellar elements outwardly.

5. The device defined in claim 4 wherein said device is a stem extending outwardly from said shutter member and said means for axially and detachably coupling said device to said fixture includes a pair of jaws on said frame engageable with said stem, and an axially displaceable actuator positioned to spread said jaws for release of said plug from said fixture, said fluid-responsive cylinder being mounted on said frame and bearing axially on said ring member.

6. The device defined in claim 4 wherein said suspension and centering device includes a formation on said shutter member engageable detachably with an end of a piston rod of a cylinder forming said driver means and mounted on said frame, said cylinder being actuatable to draw said shutter member against said ring member, said ring member being braced against said frame.

7. The device defined in claim 6 wherein said rod is connected to said shutter member by a bolt having a predetermined rupture tension sufficient to resist the axial stress on said bolt resulting from lateral deflection of said lamellar as said members are telescoped together, by rupturing upon further displacement of said members to disconnect said plug from said fixture.

8. The device defined in claim 1 further comprising a sensing means for detecting the position of said assembly within said pile for triggering the opearation of said driver means.

9. The device defined in claim 8 wherein said sensing means comprises means for sensing formations within said pile.

10. The device defined in claim 8 further comprising means for monitoring the displacement of said driver means for signalling when said lamellar elements have been deflected sufficiently to engage said abutment ring.

11. The device defined in claim 8 further comprising means on said fixture for supplying energy to said driver means.

12. The device defined in claim 1 further comprising remote control means on said fixture for remote operation of said driver means.

13. The device defined in claim 1 wherein said deformtaion fixture is connected to a central hydraulic pumping stage and corresponding remote control means for triggering said driver means.

14. As defined in claim 1 wherein said fixture has supply and control means for said driver means located at a distance from said fixture and connected thereto via respective connection ducts.

15. The device defined in claim 1 wherein said shutter member is constructed and arranged to obstruct the cross section of said pile but is provided with openings permitting the passage of water past said shutter member but preventing the passage of soil therethrough.

16. The device defined in claim 15 wherein said openings have a total cross section of 20% to 30% of the free cross sectional area of the pile.

* * * * *